United States Patent [19]

Murro

[11] 4,248,650

[45] Feb. 3, 1981

[54] METHOD AND APPARATUS FOR FORMING AN OPEN MESH CRISS-CROSS YARN NET

[76] Inventor: Ronald P. Murro, Martingale Rd., Amherst, N.H. 03031

[21] Appl. No.: 955,922

[22] Filed: Oct. 30, 1978

[51] Int. Cl.[3] ..... D04H 3/12

[52] U.S. Cl. ..... 156/181; 156/323; 156/441; 156/555; 156/583.3

[58] Field of Search ..... 156/181, 441, 439, 440, 156/177, 176, 311, 178, 324, 179, 166, 583.5, 583.3, 555, 55, 498, 323, 306; 28/100, 101, 102; 425/371; 118/56, 101, 106, 111; 100/92, 93 RP

[56] References Cited

U.S. PATENT DOCUMENTS

| | | | |
|---|---|---|---|
| 3,000,432 | 9/1961 | Olkon | 156/441 |
| 3,041,230 | 6/1962 | Diehl | 156/439 |
| 3,442,736 | 5/1968 | Diens | 156/506 |
| 3,674,583 | 7/1972 | Allport | 156/181 |
| 3,801,250 | 4/1974 | Kaiser et al. | 425/371 |
| 4,080,232 | 3/1978 | Friedrich | 156/440 |

*Primary Examiner*—Michael W. Ball

*Attorney, Agent, or Firm*—Strimbeck, Davis & Soloway

[57] ABSTRACT

A system for making self-supporting scrim is described. The apparatus includes a net forming means in which scrim yarns are arranged in overlapping pattern such as a criss-cross net; a net carrier and support for continuously advancing the criss-cross yarn net along a path; an adhesive supply means positioned along the path for applying an adhesive onto the advancing yarn net between the criss-cross yarns; and, an adhesive setting means positioned along the path for advancing the yarn net along the path while maintaining the individual yarns of the net substantially immoveable with respect to one another until the adhesive sets. In a preferred embodiment of the invention the adhesive setting means includes a pair of endless belts which engage surfaces on opposite sides of the yarn net so as to apply sandwiching pressure to the yarns and to advance the net. The various aforesaid means are inter-connected in series which together result in continuously stringing or arranging the yarns in a criss-cross or overlapping pattern, applying adhesive between the criss-cross yarns, and carrying the overlapped yarns from the adhesive supply means through the adhesive setting means to a finished scrim accumulator.

12 Claims, 3 Drawing Figures

METHOD AND APPARATUS FOR FORMING AN OPEN MESH CRISS-CROSS YARN NET

The present invention relates to a system for making scrim, and more particularly to apparatus and process for continuously manufacturing self-supporting scrim.

Scrim reinforced sheet materials are well known in the art. A typical prior art scrim reinforced sheet material may comprise a reinforcing filament or yarn which is deposited across and bonded to the sheet to be reinforced. The reinforcing filaments, which may be woven or non-woven, and may be formed of steel, rubber, mineral, plastics or other natural or synthetic fibers, provide a desired strength or other selected physical property to the sheet to be reinforced. In processes and apparatus heretofore utilized for producing reinforcing scrim the scrim typically was laminated or bonded directly to the sheet material at the time of scrim formation in order to maintain scrim geometry.

A general object of the present invention is to provide an improved system for forming a reinforcing scrim. A more specific object is to provide a process and apparatus for forming a self-supporting scrim.

A further object is to provide a process and apparatus of the character described which offers the advantages of relative simplicity, relative low cost, and ability to handle and form a variety of filaments or yarns into self-supporting scrim having a predetermined geometry.

Briefly described, in its preferred embodiment the present invention consists of providing scrim forming apparatus for continuously producing self-supporting scrim, the apparatus essentially comprising (a) net forming means for arranging a scrim yarn or yarns in an overlapping pattern such as a criss-cross, (b) adhesive supply means for applying adhesive between the criss-crossed or overlapping yarns; and (c) means for holding the criss-crossed or overlapping yarns substantially immoveable with respect to one another until the adhesive sets. The various means are inter-connected to one another along a path which together result in continuously stringing or aligning the yarns in a desired geometry, applying the adhesive between the criss-cross yarns, and maintaining the yarns substantially immoveable with respect to one another until the adhesive sets.

Other objects and many of the attendant advantages of this invention are set forth in or rendered obvious by the following detailed description. The invention accordingly comprises the apparatus possessing the construction, combination of elements and arrangement of parts, which are exemplified in the following detailed description, and the scope of application of which will be indicated in the claims.

For a fuller understanding of the nature and objects of the present invention, reference should be made to the following detailed description taken in connection with the accompanying drawings in which like numerals depict like parts and wherein.

Figure 1:
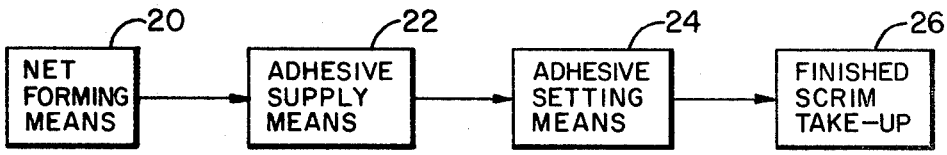
FIG. 1 is a side elevational view diagrammatically illustrating a preferred embodiment of scrim forming apparatus of the present invention.

Referring to FIG. 1 of the drawings, there is illustrated a preferred embodiment of apparatus for continuously producing self supporting scrim. The apparatus comprises a net forming means 20, an adhesive supply means 22, an adhesive setting means 24, and a finished scrim take-up means 26. Operation of the various aforesaid means of the apparatus is powered by a main power transmission indicated generally at 28 (FIG. 3).

The exact construction of net forming means 20 and the individual elements making up the means if not critical to the practice of the present invention. Thus net forming means 20 may comprise any well known means for stringing or arranging a supply of yarn or fibers in open pattern which may be criss-crossing; overlapping or abutting. For example, net forming means 20 may comprise a plurality of hoppers or spools of yarn and an equal number of yarn guides (not shown) which together are adapted to lay or string the individual yarns 32 in a criss-crossing, overlapping or abutting pattern or net 34 (FIG. 3) which may be woven or unwoven. Such means are known per se in the art and are described in detail in the patent literature (see for example U.S. Pat. Nos. 3,272,679, 3,345,231, 3,390,439, 3,490,976, 3,511,739, 3,519,509, 3,723,235, and the Patents referred to therein), and further details thereof are not deemed essential to an understanding of the invention herein. The resulting net is then transferred via a moving pin conveyor (not shown) to the adhesive supply means 22. The moving pin conveyor is also adapted to maintain the net geometry. Such means are also known per se in the art and are described in detail in one or more of the aforesaid patents, and further details thereof are not deemed essential to an understanding of the invention herein.

Figure 3:
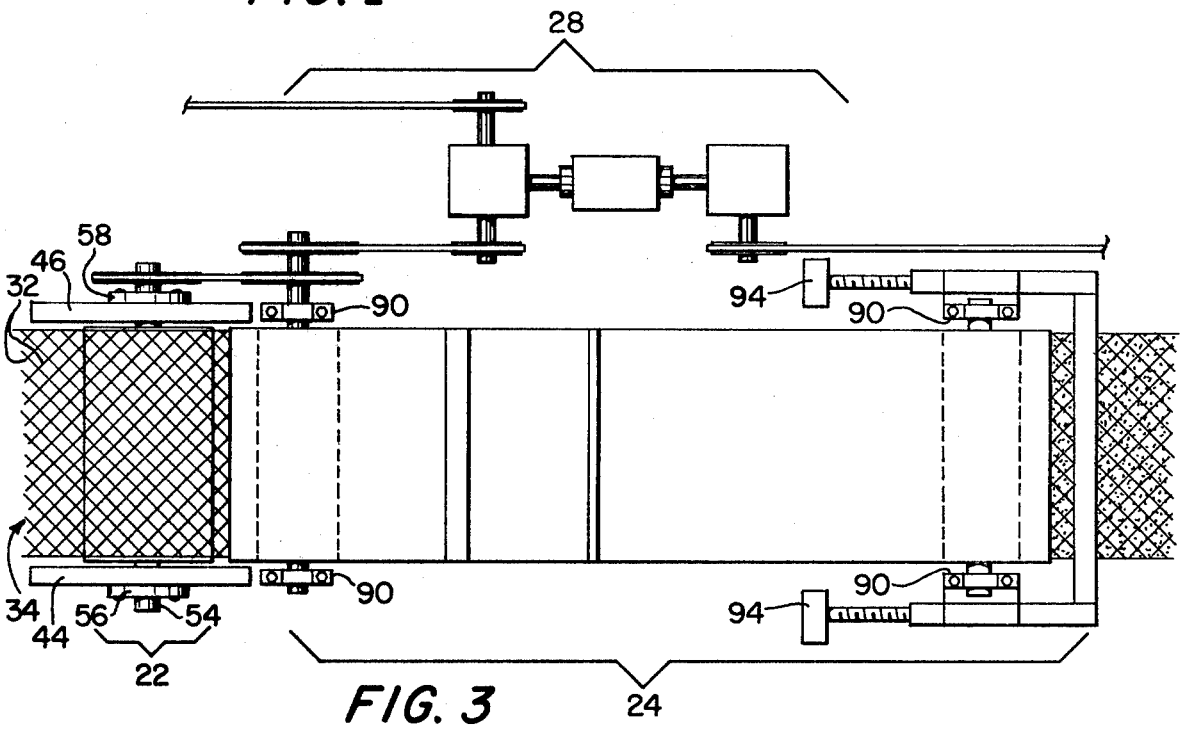
FIG. 3 is a top plan view of the basic elements of apparatus shown in FIG. 2.
Figure 2:
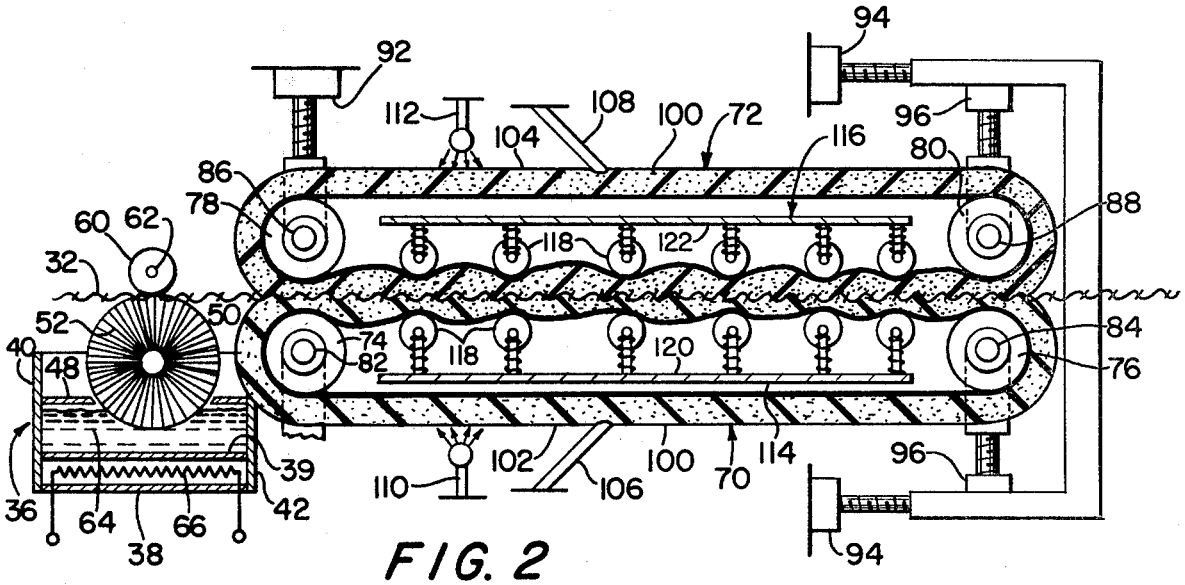
FIG. 2 is a side elevational view, partly in section, showing details of some of the basic elements of the scrim forming apparatus of FIG. 1.

Referring now to FIGS. 2 and 3, adhesive supply means 22 includes an adhesive supply reservoir in the form of an elongate trough 36. As seen in FIG. 2 trough 36 has a double walled bottom 38 and 39, substantially vertical side walls 40 and 42, and end walls 44 and 46. The top of trough 36 is closed in part by a pair of short top wall segments 48 and 50 which extend substantially horizontally from the top edges of side walls 40 and 42 between end walls 44 and 46. Completing the adhesive supply means 22 is an adhesive pickup roller 52 disposed so as partially to extend into the top end of trough 36 through the opening defined by top wall segments 48 and 50, and the top edges of end walls 44 and 46. As seen in FIG. 2, pickup roller 52 has a diameter which is somewhat greater than the distance between top wall segments 48 and 50, and the roller is disposed so as substantially to seal the opening in the top of the reservoir. Roller 52 is mounted on a shaft 54. The latter is supported in bearing blocks 56 and 58 which are mounted in known manner on end walls 44 and 46, respectively. Shaft 54 is mechanically connected to the main power transmission 28 through a series of belts and pulleys as shown in FIG. 3.

Disposed immediately above pickup roller 52 is a idler roller 60. Roller 60 is mounted on a horizontal shaft 62, the latter being mounted in known manner in bearing means (not shown) so that shaft 62 is parallel to shaft 54. A plurality of springs (not shown) are provided for biasing shaft 62 towards shaft 54 so that idler roller 60 will be pressed against driven pickup roller 52 with the yarn net 35 in the bite of the engaged rollers.

Trough 36 is partially filled with an adhesive 64 in liquid state. Adhesive 64 should be compatible with the yarn material, i.e. the adhesive should wet the yarn, and preferably is also inert or unreactive with the yarn being processed. For example, adhesive 64 may comprise a hot melt or thermo-plastic adhesive such as polyvinylchloride; a copolymer of vinyl chloride or other ethylenically unsaturated monomer; e.g. vinyl acetate, vinyllidene chloride, polystyrene; polyamide, polycarbonate; styrene-acrylonitrile; chloro- or fluoro- carbon polymers, and the like. Alternatively, the adhesive may comprise a thermosetting resin such as a polyester, epoxide, phenolic, silicon, acrylic, melamine or the like. Obviously, the choice of adhesive will determine certain construction details of the adhesive supply means 22. For example, where the adhesive is to be applied as a hot melt, trough 36 may include heating means 66 mounted between the trough double bottom walls 38 and 39 for maintaining the adhesive material in molten state.

An important feature and critical requirement of the present invention is the ability to hold the individual yarns 32 of net 34 substantially immoveable with respect to one another while the adhesive sets, while at the same time permitting continuous through-put of the net. This is accomplished by passing the net 34 through adhesive setting means 24.

Adhesive setting means 24 follows adhesive supply means 22 in line. Adhesive setting means 24 includes a pair of endless belts 70 and 72 which are adapted to run parallel to one another and to engage opposite surfaces of the advancing net 34. Belts 70 and 72 are mounted on rotatable rollers 74, 76, 78 and 80, respectively. The latter are mounted on shafts 82, 84, 86 and 88 respectively. The shafts in turn are mounted in bearing blocks 90, the latter being adjustably mounted to the stationary frame members of the adhesive setting means via adjustable screw mounts 92, 94 and 96.

Belts 70 and 72 preferably are formed of a composite of a relatively thin high strength substrate 98 to which is bonded a relatively thick layer 100 of a resiliently deformable material such as a foam rubber. Layer 100 should be of sufficient thickness and density, and should possess a sufficient modulus of elasticity so as to apply adequate sandwiching pressure between the opposed surfaces of belts 70 and 72 when pressure is applied forcing the belts towards one another. The outer surfaces 102 and 104 of belts 70 and 72 preferably are formed of a material of the non-stick type, e.g. Teflon, so that any adhesive that may be picked up on the belt outer surfaces can be removed from the belts, e.g. as by scraping by wiper blades or knives 106 and 108. If required, means 110 and 112 may be provided for spraying a release agent such as Releasa Gen (available from General Mills, Inc., Chemical Division,—the manufacturer describes this material as comprising a silicon lubricant and release agent), onto the belt outer surfaces 102 and 104.

Preferably, means are also included for applying additional sandwiching pressure along the length of the belts between rollers 74, 76, 78 and 80. For example the adhesive setting means may also include banks 114 and 116 of bearing rollers 118 disposed opposite each other interior of belts 80 and 82, respectively. Rollers 118 in turn are resiliently mounted to stationary mounting plates 120 and 122. One skilled in the art will be aware of other mechanical, hydraulic or pneumatic means that can be employed for applying additional sandwiching pressure to the belts.

One or both of the belts 70 and 72 are driven, e.g. as by mechanically coupling shafts 74 and 76 to the main power transmission through suitable pully and drive belts (see FIG. 3). Obviously, belts 70 and 72 should be driven synchronously with the net 34 so as to not disturb the yarn pattern. Means may also be included to speed setting the adhesive. For example, where the adhesive is a thermoplastic material and is applied to the net as a melt, the adhesive setting may include means to cool belts 70 and 72. Thus the adhesive setting station may be disposed within a chill box. Likewise, in the case where the adhesive is a thermosetting material, the adhesive setting station may include means for heating belts 80 and 82.

Operation of the above described apparatus is as follows: A yarn net of desired geometry is formed at net forming means 20. The yarn net is then passed in contact with adhesive supply roller 52. The adhesive comprises a hot melt blend of 45% paraffin wax (155° F. Ave. melting point), 30% Elvax 260 (available from E. I. dePont de Nemours & Co., Inc.,—the manufacturer describes this material as comprising a copolymer of ethylene and vinyl acetate); and 25% of PICCOTEX 120 (available from Hercules Powder Company, Inc. —the manufacturer describes this material as comprising a copolymer of vinyltoluene and alpha-methylstyrene)—all parts by weight. The blend is maintained in molten state at a temperature of about 325° F. in trough 36. Adhesive roller 52 is adjusted so as to have a relative velocity between it and the net advancing through adhesive supply means 22 so as to result in a monetary distortion of the net pattern. This allows adhesive to be applied between the overlapped yarns.

The net is then passed to the adhesive setting means 24 sandwiched between belts 70 and 72. The belts comprise ½ inch thick closed cell, neoprene rubber belts with a 0.010 inch thick integrally formed skin. The belts have a density of 10 lbs./ft.$^3$. The belts are pressed towards one another so as to provide a pressure between their engaged surfaces of approximately 5 psi. The linear speed of belts 80 and 82 is adjusted so as substantially to equal the linear speed of the net as it advances through the adhesive setting means 24 whereby the individual yarns will be maintained substantially immoveable with respect to one another while the net is advanced through the setting means.

The linear speed of the net and the speed of belts 80 and 82 are adjusted so that an appropriate dwell time is achieved within setting means 24 for the adhesive to set to adequately bond the yarns. The finished scrim is rolled up on a take-up roller in take-up means 26.

Certain changes may be made in the above system without departing from the scope of the invention herein involved as will be obvious to one skilled in the art. For example, the adhesive may comprise a monomeric material which may be set chemically, e.g. as by addition of a curing agent. In such case the curing agent may be applied to the advancing net, e.g. as by spraying a solution containing the curing agent onto the advancing net between adhesive supply means 22 and adhesive setting means 24. Alternatively, the curing agent may be applied from belts 70 and 72. Still other changes will be obvious to one skilled in the art, and it is therefore intended that all matter contained in the above description shall be interpreted in an illustrative and not in a limiting sense.

What is claimed is:

1. In a method of binding an open mesh, unbonded crisscross yarn net into an integral, selfsupporting net product, said method comprising the steps in sequence of:

continuously advancing said net along a path, while maintaining the individual yarns in said net substantially immoveable with respect to one another;

applying an adhesive to said net while continuously advancing said net along said path, said adhesive being applied in liquid form; and causing said adhesive to set so as to bond said individual yarns together where they overlap, the improvement which comprises passing said advancing net between a pair of endless belts driven synchronously with said advancing net said belts comprising a relatively thin high strength flexible substrate to which is bonded a relatively thick resiliently deformable material, and pressing said belts towards one another so as to engage surfaces on the opposite sides of said advancing net whereby to carry said advancing net along said path for a distance and to maintain said yarns substantially immoveable with respect to one another while said adhesive sets.

2. In a method according to claim 1, wherein said adhesive comprises a thermosetting material, and including the step of heating said thermosetting material after it is applied to said net so as to set said adhesive.

3. In a method according to claim 1, wherein said adhesive comprises a thermoplastic material, and including the step of cooling said material after it is applied to said net so as to set said adhesive.

4. In a method according to claim 1, including the step of momentarily displacing said net during said adhesive applying step so as to permit adhesive to be applied between said individual yarns.

5. In a method according to claim 1, wherein said endless belts, comprise a closed cell neoprene having an integrally formed skin, and said endless belts are pressed towards one another so as to provide a pressure between their engaged surfaces of approximately 5 psi.

6. In apparatus for binding an open-mesh, criss-cross yarn net into an integral, self-supporting net product, said apparatus comprising in combination:

means for continuously advancing an open, preformed unbonded criss-cross yarn net along a path;

adhesive supply means mounted along said path, for supplying an adhesive in liquid state onto said advancing yarn net;

and an adhesive setting means mounted along said path, for setting the adhesive on said advancing yarn net;

the improvement wherein said adhesive setting means comprises a pair of endless belts, comprising a relatively thin high strength flexible substrate to which is bonded a relatively thick each of said belts resiliently deformable material, said adhesive setting means further including means for driving said endless belts synchronously with said advancing net, and means for pressing said belts towards one another, said belts being adapted to engage surfaces on the opposite sides of said yarn net whereby to sandwich and carry said net for a distance along said path and to maintain the individual yarn of said net substantially immoveable with respect to one another while providing an environment for setting said adhesive.

7. In apparatus according to claim 5, wherein said adhesive comprises a thermoplastic material and including means for maintaining said adhesive in said adhesive supply means in molten condition.

8. In apparatus according to claim 7, and including means for cooling said endless belts.

9. In apparatus according to claim 5, wherein said adhesive comprises a thermosetting material, and including means for supplying heat to said endless belts.

10. In apparatus according to claim 5, and including means for adjusting the sandwiching pressure between said belt engaged surfaces.

11. In apparatus according to claim 5, and including means for applying a release agent to the surfaces of said belts which engage said net.

12. In Apparatus according to claim 5, wherein said endless belts comprise a closed cell, neoprene having an integrally formed skin, and said means for pressing is adapted to apply a sandwiching pressure of approximately 5 psi.

* * * * *